United States Patent [19]

Kashimoto

[11] Patent Number: 4,995,606

[45] Date of Patent: Feb. 26, 1991

[54] BOARD GAME

[75] Inventor: Kiyoshi Kashimoto, Tokyo, Japan

[73] Assignee: Tomy Kogyo Co., Inc., Tokyo, Japan

[21] Appl. No.: 421,781

[22] Filed: Oct. 16, 1989

[30] Foreign Application Priority Data

Dec. 19, 1988 [JP] Japan ..... 63-164227[U]

[51] Int. Cl.[5] ..... A63F 9/00

[52] U.S. Cl. ..... 273/1 GG

[58] Field of Search ..... 273/1 GA, 1 GC, 1 GG; 446/241, 138; 434/258, 260

[56] References Cited

U.S. PATENT DOCUMENTS 4,239,213 12/1980 Jarvis ..... 273/1 GA
4,437,262 3/1984 Kaga ..... 446/138
4,790,532 12/1988 Chen ..... 273/1 GG X

FOREIGN PATENT DOCUMENTS 743827 10/1966 Canada ..... 273/1 GF
551660 6/1932 Fed. Rep. of Germany ..... 446/241
3626284 2/1988 Fed. Rep. of Germany ..... 446/241
956974 8/1949 France ..... 273/1 GA

*Primary Examiner*—Paul E. Shapiro
*Attorney, Agent, or Firm*—Staas & Halsey

[57] ABSTRACT

A game board including a plurality of spiral rods mounted on an upper surface of a base and rotated in association with the drive mechanism in the base. A ring member is loosely received by a spiral rod and a manipulator is used to remove the ring member while the spiral rod is rotating.

7 Claims, 3 Drawing Sheets

BOARD GAME

BACKGROUND OF THE INVENTION

The present invention relates to a game board in which players compete with each other to see who can remove a ring member from a rotating spiral rod quickest.

Board games are known where a player uses a hand-held member to remove an object from a stationary playing surface. However, since the playing surface is stationary, the player soon masters the game and looses interest therein.

SUMMARY OF THE INVENTION

It is an object of the present invention to provide a game board having a simple structure and requiring only simple rules and instructions.

It is another object of the present invention to provide a game board which maintains and heightens a player's interest in the game.

Accordingly, to satisfy the above and other objects, the present invention includes a plurality of spiral rods mounted on an upper surface of a base and rotated in association with a drive mechanism in the base. A ring member is loosely received by the base end of each of the spiral rods. The goal of the game is for a player to remove a ring using a manipulator having bifurcated forward ends, while the spiral rod is rotating. Players compete with each other based on the amount of time it takes a player to use the manipulator to remove the ring member from the rotating spiral rod without the ring member being dropped or hitting the rotating spiral rod.

DETAILED DESCRIPTION OF THE PREFERRED EMBODIMENTS

Embodiments of the present invention will be explained hereinbelow with reference to the drawings.

Figure 1:
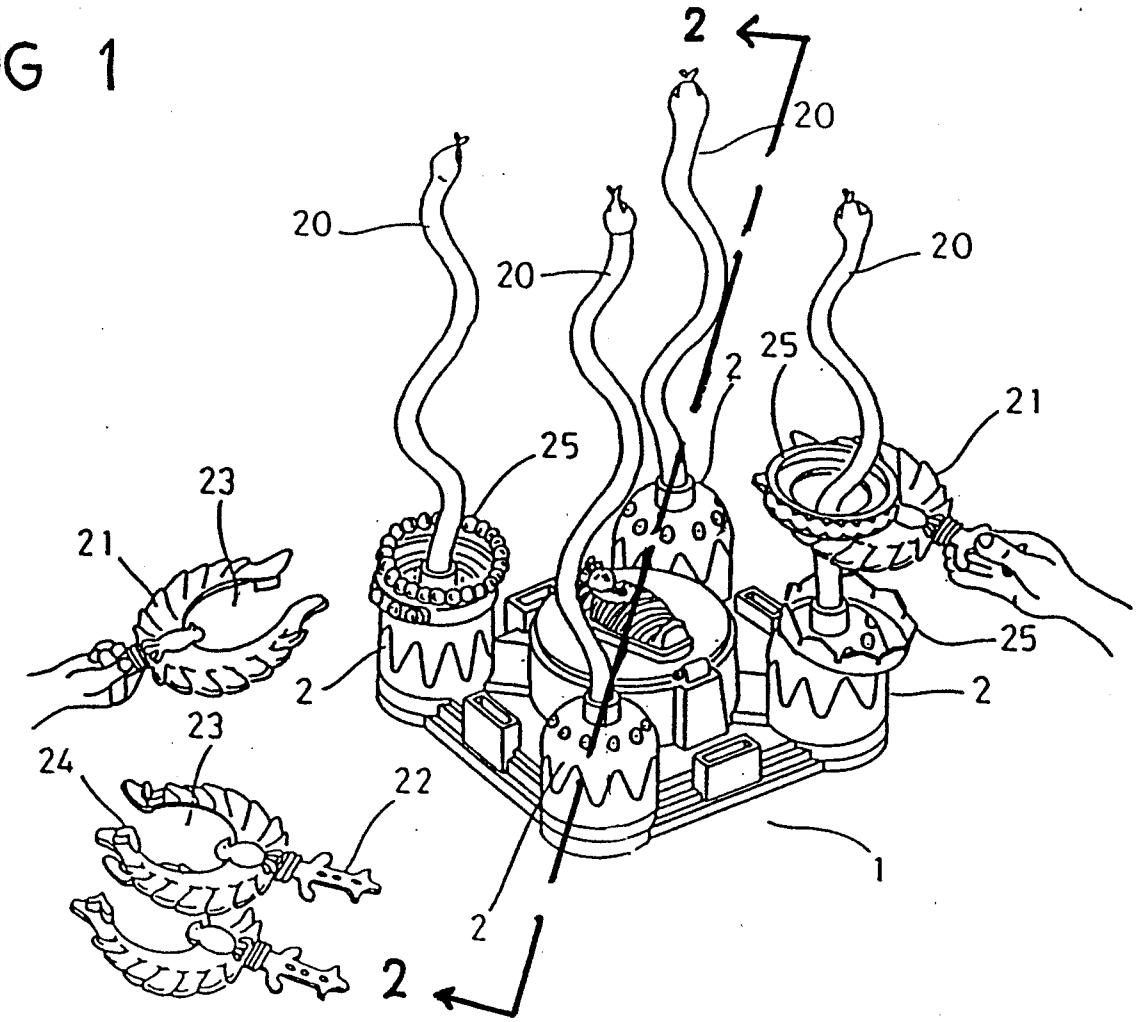
FIG. 1 is a perspective view illustrating the exterior of a game board and the manipulators according to the present invention.
Figure 2:
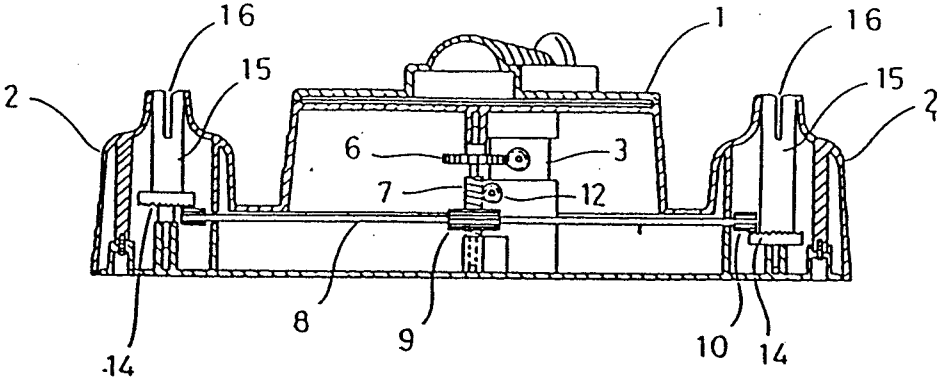
FIG. 2 is a transverse cross-sectional view of the FIG. 1 game board.
Figure 3:
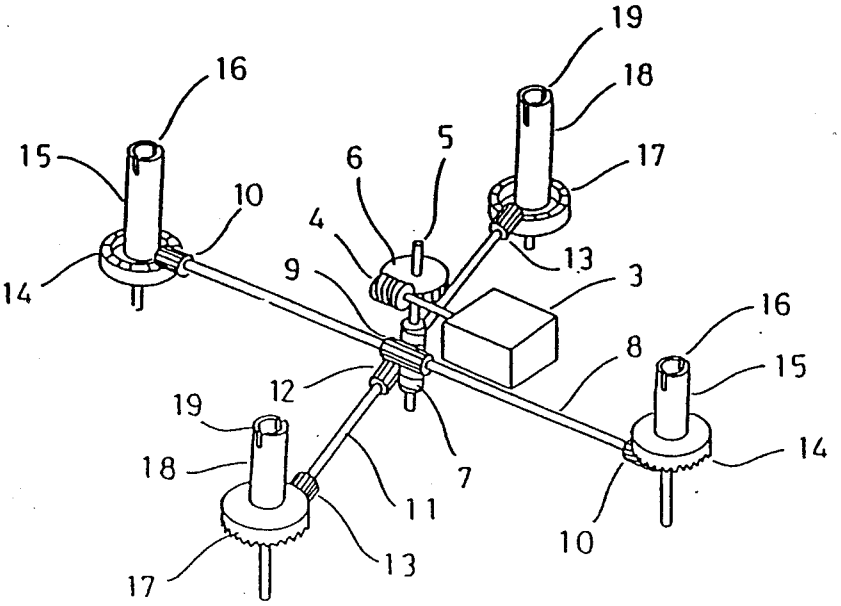
FIG. 3 is a perspective view illustrating the drive mechanism used in the FIG. 1 game board.

As shown in FIGS. 1 and 2, the base 1 is formed in a rectangular substantially flat box shape, and includes supports 2 at the four corners of the base 1. The supports 2 are formed at positions symmetrical with respect to each other and with respect to an imaginary intersecting diagonal lines across the base 1, such as the line 2—2. A motor 3 is fixed to a center part of the base 1 as shown in FIGS. 2 and 3. A motor pinion 4 meshes with a gear 6 journalled to a gear shaft 5, and a worm gear 7 is journalled, coaxially with the gear 6, to a gear shaft 8. The worm gear 7 meshes with a worm wheel 9 journalled to the gear shaft 8 and a worm wheel 12 journalled to a gear shaft 11, respectively. Further, pinions 10 are journalled to both ends of the gear shaft 8, and mesh with crown gears 14. Cylindrical members 15 are journalled to coaxially with the crown gears 14, and are rotatably fitted in the supports 2. Further, the upper ends of each cylindrical member 15 are made to enter into openings formed in the center of the upper ends of the supports 2.

Pinions 13 are journalled to both end parts of the gear shaft 11, and mesh with crown gears 17. Cylindrical members 18 are journalled coaxially with the crown gears 17 and are rotatably fitted in the supports 2. The upper ends of the cylindrical members 18 are made to enter into openings formed in the centers of the upper ends of the supports 2. Spiral rods 20 (FIG. 1), which are preferably spiraled along their entire lengths, are formed at their upper ends with heads 20*a* so as to have a snake-like appearance. Projections (not shown) project from the lower ends of the spiral rods 20 and are removably fitted in grooves 16, 19 formed in the cylindrical members 15 and 18, respectively.

Figure 5:
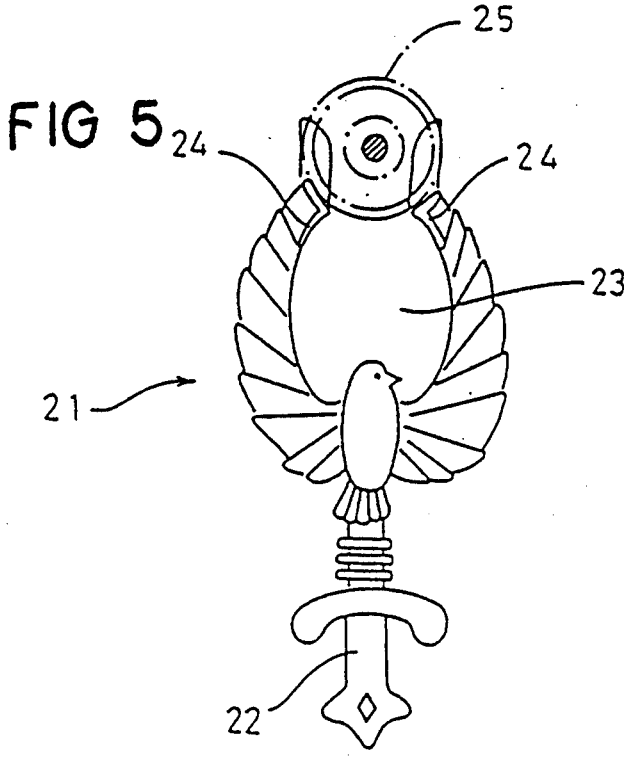
FIG. 5 is a plan view illustrating a manipulator in combination with a ring member.

Referring to FIG. 5, manipulators 21 are preferably formed as guard-like members. Each manipulator 21 has a pair of arcuate, bifurcated pieces 21*a* which define a center space 23 therebetween. Each bifurcated piece 21*a* includes at a free end 22*a* thereof angle shaped engaging projections 24 projecting from one inside end surface thereof. Each manipulator 21 also includes a handle 22. The space 23 is wider midway of the bifurcated pieces 21*a* than at the free ends 22*a* thereof and is therefore so arranged that ring members 25, which are explained below, can be easily carried on the bifurcated pieces 21*a* near the space 23, without being substantially affected by the rotating spiral rods 20.

Figure 4:
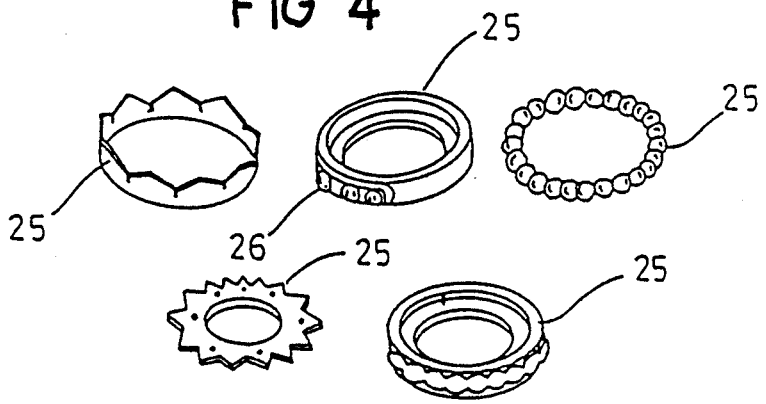
FIG. 4 is a perspective view illustrating various ring members.

The ring members 25 are preferably formed to have different shapes such as shown in FIG. 4, and to have different weights. For example, one has a weighted portion 26*a* formed on its outer surface, one has a smaller inner diameter of 27, and one has a flat shape 28.

The way in which the game is played will now be explained.

To start the game, the ring members 25 are placed over the spiral rods 20, and onto the supports 2. When a switch (not shown) provided on the base 1 is activated, the motor 3 moves and the spiral rods 20 rotatably mounted on the base 1 are rotated. Each player moves his or her manipulator 21 toward his or her spiral rod 20. The player then moves the manipulator 21 under a ring 25 and tries to move the ring member 25 upward without causing the ring member 25 to drop if it strikes the rotating spiral rod 20. The goal is to remove the ring member 25 from the upper part of the spiral rod 20, i.e., beyond the head 20*a*. The first player who removes all ring members 25 from his or her spiral rod 20 is the winner.

The game board having the above-mentioned structure can be set up to have various degrees of difficulty, depending upon the ability of the players. That is, as a rule, a player could use only the forward ends 24*a* formed on the bifurcated, arcuated pieces 21*a* of the manipulator 21. In this way, only flat surfaces, on which no engaging projections 24, 24 are formed, are used to receive the ring member 25. Further, using ring members 25 of the types which are difficult to be carried, e.g., the weighted version can be used. Combinations of the above can be used by players in a wide range.

The present invention as described above, includes a plurality of spiral rods which appear like a plurality of snakes dancing. This game board satisfies visual interest, and the use of the manipulator for removing the ring members from the base end part of the rotating spiral rod without the ring member being dropped after contacting the spiral rod leads to an interesting game, and can therefore provide a game board with which the players in a wide range can enjoy.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

I claim:

1. A game board, comprising:

a base;

drive means mounted within said base;

a first movable member operatively connected to said drive means so as to be movable relative to said base;

a second movable member positioned on said base and about said first movable member;

manipulating means for receiving said second movable member and removing said second movable member from said base and from about said first movable member as said drive means moves the first movable member.

2. The game board as recited in claim 1, wherein said first movable member comprises: an upright spiral rod rotatably connected to said drive means.

3. The game board as recited in claim 2, wherein said second movable member comprises a ring.

4. The game board as recited in claim 1, wherein said drive means comprises:

a motor;

cylindrical member, and a gear train operatively connected to transmit power from said motor to said cylindrical member.

5. The game board as recited in claim 4, further comprising a support on said base positioned about said cylindrical member.

6. The game board as recited in claim 5, wherein said manipulating means comprises a hand held member including a handle and spaced, bifurcated pieces for positioning around said first movable member and for moving said second movable member.

7. A game comprising:

a base having a plurality of supports positioned thereon;

a plurality of first movable members respectively positioned within corresponding ones of said supports;

motor means for providing a drive force;

a linkage mechanism connected between said motor means and each of said first movable members so as to transmit said drive force to and to move each of said movable members;

a plurality of second movable members connectable to respective ones of said first movable members;

a plurality of third movable members having an opening for accepting respective ones of said second movable members; and a manipulator including a handle and spaced apart protrusions for accepting a selected one of said third movable members.

* * * * *